US010480147B2

(12) United States Patent
Cascarino et al.

(10) Patent No.: US 10,480,147 B2
(45) Date of Patent: Nov. 19, 2019

(54) DRILLING MACHINE

(71) Applicant: SOLETANCHE FREYSSINET, Rueil Malmaison (FR)

(72) Inventors: Sara Cascarino, Reuil Malmaison (FR); Daniel Perpezat, Reuil Malmaison (FR); Laurent Pivert, Reuil Malmaison (FR); Régis Bernasinski, Reuil Malmaison (FR)

(73) Assignee: Soletanche Freyssinet, Rueil Malmaison (FR)

( * ) Notice: Subject to any disclaimer, the term of this patent is extended or adjusted under 35 U.S.C. 154(b) by 57 days.

(21) Appl. No.: 15/758,761

(22) PCT Filed: Sep. 8, 2016

(86) PCT No.: PCT/FR2016/052245
§ 371 (c)(1),
(2) Date: Mar. 9, 2018

(87) PCT Pub. No.: WO2017/042495
PCT Pub. Date: Mar. 16, 2017

(65) Prior Publication Data

US 2019/0040601 A1 Feb. 7, 2019

(30) Foreign Application Priority Data

Sep. 10, 2015 (FR) ..... 15 58425

(51) Int. Cl.
*E02D 17/13* (2006.01)
*E02F 3/18* (2006.01)
(Continued)

(52) U.S. Cl.
CPC ..... *E02D 17/13* (2013.01); *E02F 3/188* (2013.01); *E02F 3/205* (2013.01); *E02F 3/22* (2013.01)

(58) Field of Classification Search
CPC ..... E02D 17/13; E02F 3/188; E02F 3/205; E02F 3/22
See application file for complete search history.

(56) References Cited

U.S. PATENT DOCUMENTS 3,554,603 A * 1/1971 Kampf-Emden et al. ..... E21D 9/1093 299/31
5,707,182 A * 1/1998 Leffer ..... E02D 17/13 405/267

(Continued)

FOREIGN PATENT DOCUMENTS

| | | | | |
|---|---|---|---|---|
| CA | 2998309 A1 * | 3/2017 | ..... | E02D 17/13 |
| EP | 1746213 A1 | 1/2007 | | |
| FR | 2806112 A1 | 9/2001 | | |

*Primary Examiner* — Jamie L McGowan
(74) *Attorney, Agent, or Firm* — Yasser Mourtada

(57) ABSTRACT

The invention relates to a drilling machine (10) for making an excavation in ground in a drilling direction, said drilling machine comprising: an anchor module (12) having an anchor device for preventing the anchor module from moving in the drilling direction relative to the ground by bearing against one of the walls of the excavation;

a drilling module (20) provided with cutter members connected to the anchor module while being movable in translation relative to the anchor module; and movement means (35) for moving the cutter members in translation relative to the anchor module.

The drilling module is also hinged relative to the anchor module, and the drilling machine comprises first path correction means (40) for causing the drilling module to pivot relative to the anchor module about a pivot axis (X) perpendicular to the drilling direction.

16 Claims, 6 Drawing Sheets

(51) Int. Cl.
*E02F 3/20* (2006.01)
*E02F 3/22* (2006.01)

(56) References Cited

U.S. PATENT DOCUMENTS

| | | | | |
|---|---|---|---|---|
| 6,793,444 | B2 * | 9/2004 | Kondo | E02D 33/00 175/98 |
| 7,367,143 | B2 * | 5/2008 | Stoetzer | E02D 17/13 175/91 |
| 7,637,038 | B2 * | 12/2009 | Arzberger | E02F 3/205 299/34.11 |
| 7,661,209 | B2 * | 2/2010 | Arzberger | E02D 17/13 175/96 |
| 8,640,364 | B2 * | 2/2014 | Arzberger | E02D 17/13 37/189 |
| 2003/0074810 | A1 * | 4/2003 | Gessay | E02D 17/13 37/347 |

* cited by examiner

DRILLING MACHINE

BACKGROUND OF THE INVENTION

The present invention relates to the field of drilling in the ground, in particular in order to construct foundations, e.g. such as continuous screens constituted by juxtaposed concrete wall elements.

The invention relates more precisely to a drilling machine for excavating in ground, and more particularly in hard soil.

The invention relates more precisely to a drilling machine for making an excavation in ground in a drilling direction, said excavation having walls and said drilling machine comprising:

an anchor module having at least an anchor device for preventing the anchor module from moving in the drilling direction relative to the ground by bearing against one of the walls of the excavation;

a drilling anchor module provided with cutter members, the cutter members being movable in translation relative to the anchor module; and movement means for moving the cutter members in translation relative to the anchor module.

Such a machine is described in particular in Document FR 2 806 112. It comprises anchor means that make it possible to prevent the main frame from moving in the vertical drilling direction relative to the walls of the trench, and means for exerting downwardly-directed vertical thrust on the milling assembly.

Such a machine makes it possible to exert vertical thrust on the cutter members of magnitude that is much greater than the weight of the frame, thus making it possible to drill in hard soil, such as for example granite.

A drawback with that machine is that the cutter members may tend to slip on portions of hard ground, running the risk of causing the path of the drilling machine to be deflected, and this becomes problematic, in particular when drilling to great depth.

OBJECT AND SUMMARY OF THE INVENTION

An object of the present invention is to remedy the above-mentioned drawbacks by proposing a drilling machine that makes it possible to drill hard soil while controlling the drilling trajectory.

To do this, the drilling module is hinged relative to the anchor module and the drilling machine includes at least first path correction means configured to cause the drilling module to pivot relative to the anchor module about a pivot axis extending transversely relative to the drilling direction.

The drilling direction is substantially vertical, and at any rate it is not horizontal.

Because it is hinged, the drilling module is mounted in particular to pivot relative to the anchor module. Pivoting the drilling module relative to the anchor module makes it possible to modify the position of the cutter members, and thereby correct the path followed by the drilling machine.

Preferably, the first drilling path correction means are actuated while the anchor device is actuated, i.e. while the anchor module is braced in the ground.

It can thus be understood that when it is desired to correct the path of the drilling machine, the anchor module is held stationary in the ground by actuating the anchor device, the drilling module is pivoted relative to the anchor module by acting on the first path correction means, and the movement means are used to move the drilling module downwards in translation relative to the anchor module. In the invention, it is also possible to pivot the drilling module relative to the anchor module before, after, or while moving the drilling module in translation relative to the anchor module. It can thus be understood that the invention makes it possible to correct the drilling direction accurately because of the anchoring of the anchor module.

Another advantage of the invention is to be able to transmit a force towards the cutter members in a direction that is inclined relative to the longitudinal direction of the anchor module, this force possibly being of very great magnitude insofar as it is possible to exert thrust on the drilling module while bearing against the walls of the excavation because the anchor module is anchored in the ground.

In another variant, the anchor module is held stationary in the ground after the drilling module has been pivoted relative to the anchor module in order to correct the path.

The hinging between the drilling module and the anchor module is provided by a hinge member that may be embodied by one or more pivot type connections, by a ball joint type connection, or by any other equivalent type of hinge means. The hinge member may form part of the movement means, or it may be arranged between the movement means and the drilling means, or indeed between the movement means and the anchor means.

In a first embodiment of the invention, the anchor module includes the first path correction means that are configured to exert thrust on the drilling module in a direction extending transversely relative to the drilling direction, whereby actuating the first path correction means causes the drilling module to pivot relative to the anchor module.

It can be understood that when the anchor module is anchored to the ground in the excavation, it constitutes a stationary support. Thus, thrust exerted on the drilling module by the first path correction means arranged on the anchor module has the effect of causing the drilling module to pivot relative to the anchor module because of the hinge that exists between the drilling module and the anchor module. This pivoting takes place about the pivot axis that extends transversely relative to the drilling direction, which axis is preferably horizontal.

Preferably, the pivot axis passes through the anchor module.

Advantageously, the drilling module has a bottom section carrying the cutter members, and a top section extending at least in part inside the anchor module, and wherein the first path correction means are arranged between the anchor module and the top section of the drilling module. The bottom and top sections may be securely fastened to each other so as to form one-piece body, or they may be movable relative to each other.

Thus, the drilling module is pivoted relative to the anchor module by the action of the first path correction means on the top section of the drilling module.

Considered in a plane perpendicular to the drilling direction, the bottom section of the drilling module presents a length that is preferably substantially equal to the length of the anchor module. The same applies to the respective widths of the bottom section of the drilling module and of the anchor module.

Advantageously, the top section of the drilling module is movable inside the anchor module. Preferably, the top section of the drilling module is movable in translation and in rotation relative to the anchor module.

In a first variant of the first embodiment, the first path correction means are arranged in the top portion of the anchor module, with the pivot axis being arranged in the bottom portion of the anchor module, so as to benefit from a lever arm that is substantially equal to the length of the anchor module.

In this first variant, the bottom section of the drilling module may be mounted to slide relative to the top section of said drilling module. Thus, while the movement means are in operation, the bottom section carrying the cutter members move in translation relative to the top section in the drilling direction. The drilling module thus includes a retracted position in which the distance between the cutter members and the top section is at a minimum, and a deployed position in which the distance between the cutter members and the top section is at a maximum. The assembly constituted by the top and bottom sections is mounted to pivot relative to the anchor module.

In a second variant, the anchor module has a body and a longitudinal sleeve in which the top section of the drilling module is slidably mounted, the longitudinal sleeve being hinged relative to the body. The sleeve is preferably mounted to pivot relative to the body about the pivot axis. The first path correction means are configured to push the sleeve so as to cause it to pivot relative to the body of the anchor module, thereby causing the drilling module to pivot relative to the anchor module. Preferably, but not exclusively, the first path correction means are arranged on the sleeve.

Preferably, the top section of the drilling module passes longitudinally through the anchor module. Also preferably, the top end of the top section projects above the top end of the anchor module.

Advantageously, the drilling machine further comprises second path correction means that are situated on the bottom section of the drilling module and that are configured to exert thrust on one of the walls of the excavation along said direction extending transversely to the drilling direction.

The combined action of the first and second path correction means serves to facilitate pivoting the drilling module about the pivot axis by exerting thereon torque that is greater than that exerted by the first path correction means alone.

Advantageously, the first path correction means comprise at least one thrust pad.

In the first variant, the thrust pad exerts thrust on the top section of the drilling module, while in the second variant, the thrust pad exerts thrust on the sleeve.

Preferably, said thrust pad is actuated by an actuator mounted on the anchor module.

In a second embodiment, the first path correction means are arranged on the drilling module and are configured to exert thrust on one of the walls of the excavation in a direction that extends transversely relative to the drilling direction, whereby actuating the first path correction means causes the drilling module to pivot relative to the anchor module.

Given that the walls of the excavation remain stationary, it can be understood that actuating the first path correction means so as to cause thrust to be exerted on the excavation walls in a direction that extends transversely relative to the drilling direction, has the effect of causing the drilling module to pivot about a pivot axis that is perpendicular to the drilling direction, which axis is preferably substantially horizontal. It is specified that the weight of the anchor module is preferably greater than the weight of the drilling module.

Preferably, the first path correction means are arranged on the front and rear faces of the drilling module so as to be able to pivot the drilling module relative to the drilling module either forwards or rearwards when considered in a first vertical plane. When the machine is a milling machine, the front and rear faces are perpendicular to the axes of rotation of the drums.

The first path correction means may also be arranged on the lateral sides of the drilling module in order to enable pivoting towards one or the other of the two lateral sides to take place in a second vertical plane that is orthogonal to the first vertical plane.

In another embodiment, the first path correction means comprise a set of motor-driven actuators configured to cause the drilling module to pivot relative to the anchor module without necessarily bearing against the walls of the excavation.

Advantageously, the movement means are mounted to pivot relative to the anchor module, preferably about said pivot axis. In other words, the drilling module pivots with the movement means when the first path correction means are actuated.

In particularly advantageous manner, the movement means comprise at least one thrust device for exerting downwardly directed thrust on the cutter members along the drilling direction.

It can be understood that the thrust device makes it possible to ensure that the cutter members remain in contact with the soil that is to be cut up.

The thrust device preferably includes at least one thrust actuator arranged between the anchor module and the drilling module. Also preferably, the thrust device includes a pair of thrust actuators arranged on either side of a longitudinal midplane of the drilling machine.

Advantageously, the anchor device has at least one anchor pad suitable for bearing against one of the walls of the excavation to prevent the anchor module from moving along the drilling direction relative to the ground.

The anchor pad is deployed in a direction that is transverse, and preferably orthogonal, relative to the drilling direction. Preferably, each of the front and rear faces of the anchor module is fitted with at least one anchor pad.

Advantageously, on each of the front and rear faces of the anchor module, the anchor pad(s) define a substantially continuous surface extending along a height measured in the longitudinal direction of the anchor module that is not less than two-thirds of the height of said drilling module.

In another variant, the anchor device includes a plurality of inflatable cushions arranged against at least one, and preferably both, of the front and rear faces of the anchor module. The anchor module is anchored by inflating the cushions so that they bear against the walls of the excavation.

In a particularly advantageous aspect of the invention, the drilling machine has damper means for damping the vibration generated by the cutter members while drilling.

In an embodiment, the damper means act on the hydraulic circuit powering the thrust actuators. For example, they are constituted by an accumulator type hydraulic member connected to the hydraulic feed of the thrust actuator. In a variant, the damper means could equally well include spring means arranged in parallel with the thrust actuators.

In a preferred embodiment, the drilling machine includes a lift cable, with the drilling module being suspended from the bottom end thereof.

The lift cable extends vertically from a boom of a carrier, itself known.

Advantageously, the top section of the drilling module is mounted to slide in the anchor module while being suspended from the bottom end of the lift cable.

In a preferred but non-exclusive embodiment, said drilling machine is a milling machine in which the cutter members comprise two pairs of drums that are rotatable about axes of rotation that are parallel, distinct, and perpendicular to the drilling direction.

Advantageously, the first path correction means are configured to cause the drilling machine to pivot relative to the anchor module about a pivot axis extending perpendicularly to the drilling direction that is perpendicular to the drilling direction and to the axes of rotation of the drums.

BRIEF DESCRIPTION OF THE DRAWINGS

The invention can be better understood on reading the following description of an embodiment of the invention given by way of non-limiting example and with reference to the accompanying drawings, in which.

DETAILED DESCRIPTION OF THE INVENTION

Figure 4:
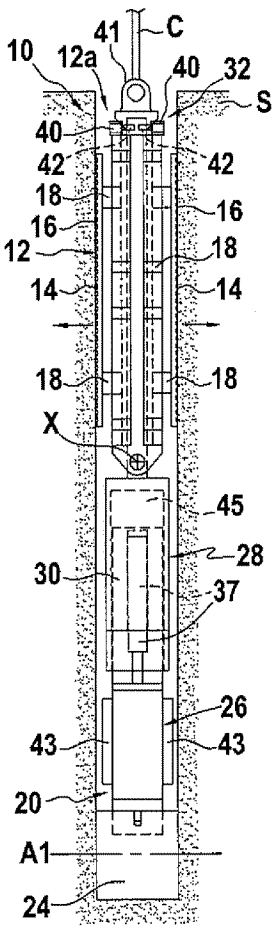
FIG. 4 is a side view of the FIG. 1 machine with the anchor device activated.

With reference to FIGS. 1 to 12, there follows a description of a first variant of a first embodiment of the drilling machine 10 in accordance with the present invention. The drilling machine 10 serves to make an excavation E in ground S along a drilling direction DF. In the figures, the vertical direction is referenced V. As can be understood from, the drilling direction DF may be vertical, or may slope a little relative to the vertical direction V.

Considered in a horizontal plane, the excavation E presents the shape of a trench that is substantially rectangular and that defines walls referenced P1, P2, P3, and P4 that are substantially vertical. The machine presents a height H, a length L, and a width 1. As can be understood from FIGS. 2 and 3 the height H of the machine extends substantially vertically, while the length L and the width 1 extend in a plane that is substantially horizontal and they define substantially the length and the width of the cross-section of the excavation E.

In this example, the drilling machine 10 is a milling machine suspended from the bottom end of a lift cable C that is carried by a boom of a hoist (not shown) itself known.

In this example and as explained in greater detail below, the drilling machine 10 has an anchor module 12 that is provided with four anchor devices 14 that are configured to prevent the anchor module 12 from moving in the drilling direction relative to the ground S by bearing against the walls P1 and P2 of the excavation E.

The anchor devices 14 comprise anchor pads 16 that are suitable for bearing against the walls P1 and P2 of the excavation, as shown in particular in FIGS. 4 to 6 and 10 to 12, so as to prevent the anchor module from moving in the drilling direction relative to the ground during the drilling operation. The anchor pads 16 are actuated by actuators 18 that are configured to exert horizontal thrust on the anchor pads 16 so that they become pressed against the facing walls P1 and P2 so as to prevent the anchor module from moving in the ground.

In this example, the anchor module has four pads 16 extending over substantially the full height of the anchor module 12. Without going beyond the ambit of the present invention, provision could be made for some other number of pads, providing the number of pads and their surface area are sufficient for preventing the anchor module from moving in the ground during drilling operations.

The drilling machine 10 also has a drilling module 20 that is provided with cutter members 22. In this example, the cutter members 22 comprise two pairs of drums 24 that are rotatable about axes of rotation A1 and A2 that are parallel, distinct, and perpendicular to the drilling direction DF.

Figure 3:
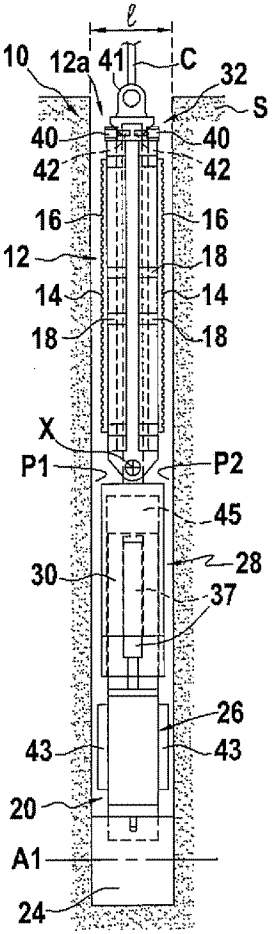
FIG. 3 is a side view of the FIG. 1 machine.
Figure 2:
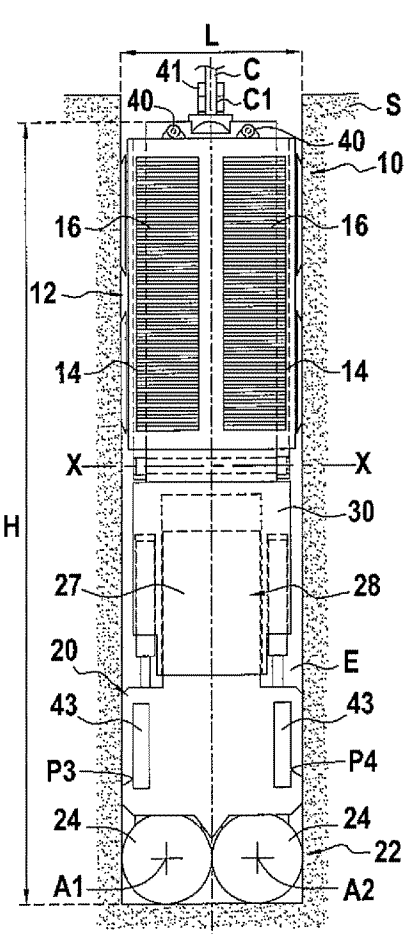
FIG. 2 is a face view of the FIG. 1 machine.

With reference to FIGS. 2 and 3, it can be understood that the axes of rotation A1, A2 extend across the width 1 of the drilling machine 10.

Figure 8:
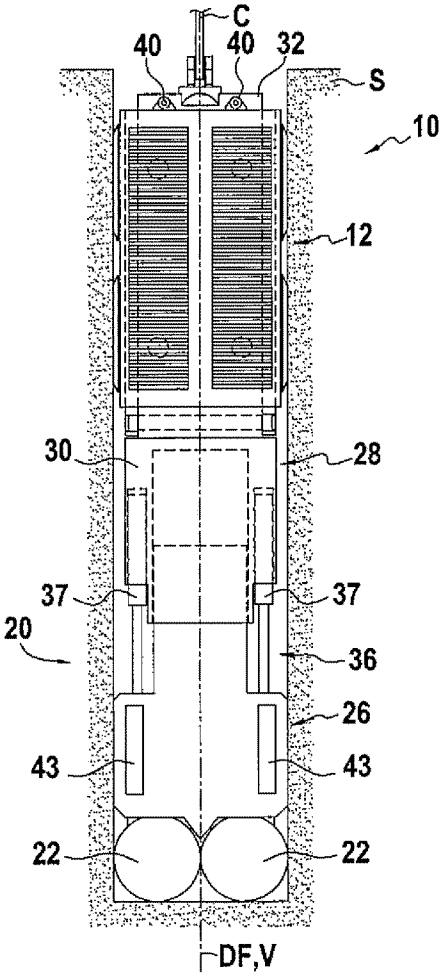
FIG. 8 is a face view of the FIG. 7 machine.

As can be understood from FIGS. 2 and 8, the cutter members are connected to the anchor module while being movable in translation relative to said anchor module. For this purpose, the drilling machine 10 has movement means 35 for moving the cutter members 22 in translation relative to the anchor module 12.

The drilling module 20 has a bottom section 26 that carries the cutter members 22, and a top section 28. The top section 28 has both a bottom portion 30 and also a top portion 32 that passes longitudinally through the anchor module 12. As can be understood from FIGS. 2 and 8, the bottom section 26 of the drilling module is mounted to be slidably movable relative to the bottom portion 30 of the top section 28 of the drilling module 20. The movement means, which are configured to move the drilling members relative to the anchor module 12, comprise a thrust device 36, specifically thrust actuators 37 configured to exert thrust on the cutter members, which thrust is directed downwards along the drilling direction DF.

In FIGS. 1 to 6, the drilling module is in its retracted position, i.e. the distance between the drilling tools 22 and the anchor module 12 is at a minimum. In this retracted position, the bottom section 26 of the drilling module has a top portion 27 that is engaged in the bottom portion 30 of the top section 28 of the drilling module. In FIGS. 7 to 12, the drilling module is in the deployed position, i.e. the distance between the drilling tools 22 and the anchor module 12 is at a maximum.

In accordance with the invention, the drilling module 20 is also hinged relative to the anchor module 12. In this example, the hinge consists in a pivot connection about a pivot axis X defined between the anchor module 12 and the drilling module 20. The pivot axis X is perpendicular to the drilling direction DF, and in this example it extends substantially horizontally. In this first embodiment, the pivot axis X is situated between the bottom portion 30 and the top portion 32 of the top section 28 of the drilling module 20. It can also be seen that the pivot axis X is arranged at the bottom end of the anchor module 12. Furthermore, the top portion 32 of the top section 28 of the drilling module 20 extends inside the anchor module 12 and projects above the top end 12*a* of the anchor module 12. It can thus be understood that the top section 28 of the drilling module 20 is mounted to pivot about the pivot axis X relative to the anchor module 12. This hinging serves to correct the drilling path by enabling the drilling module to pivot. For this purpose, the drilling machine also has first and second path correction means 40 that are configured to cause the drilling module 20 to pivot relative to the anchor module 12 about the pivot axis X. It is also specified that the thrust actuators 37 pivot with the cutter members 22.

Figure 7:
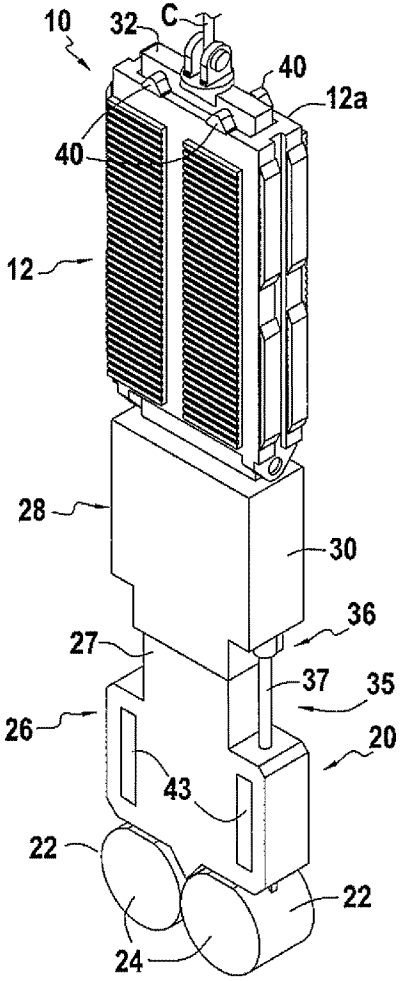
FIG. 7 is a perspective view of a first variant of the first embodiment of the drilling machine, the drilling module being in the deployed position.
Figure 6:
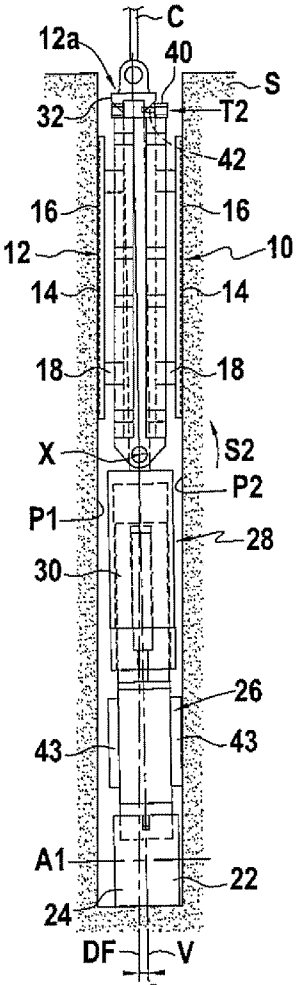
FIG. 6 is a side view of the FIG. 1 machine, with the anchor device activated and with the drilling module pivoted relative to the anchor module in a second direction opposite to the first direction.
Figure 5:
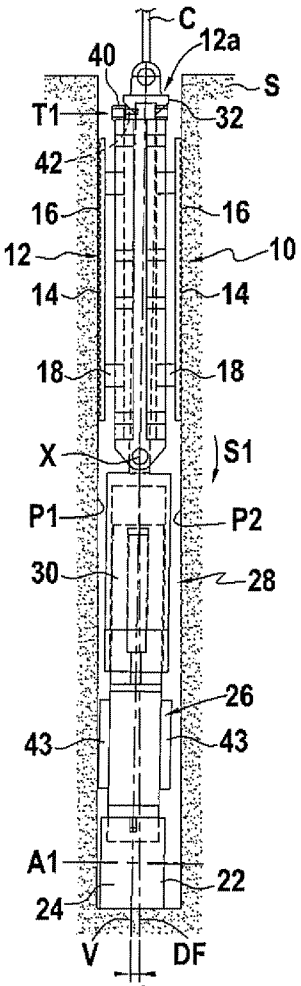
FIG. 5 is a side view of the FIG. 1 machine with the anchor device activated and with the drilling module pivoted relative to the anchor module in a first direction.
Figure 12:
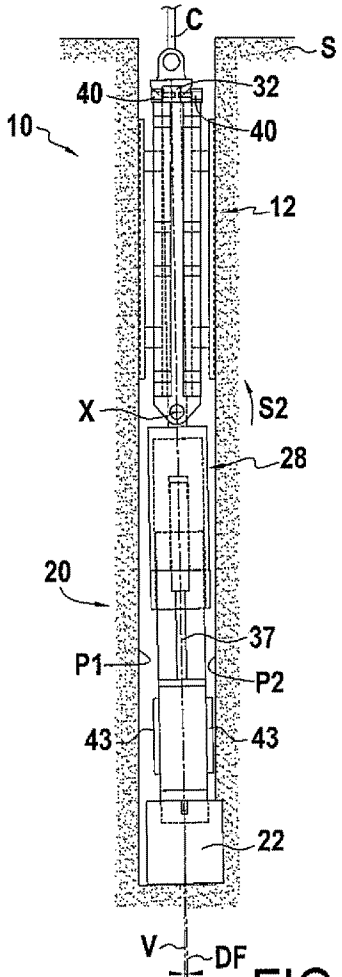
FIG. 12 is a side view of the FIG. 7 machine, with the anchor device activated and with the drilling module pivoted relative to the anchor module in a second direction, opposite to the first direction.
Figure 11:
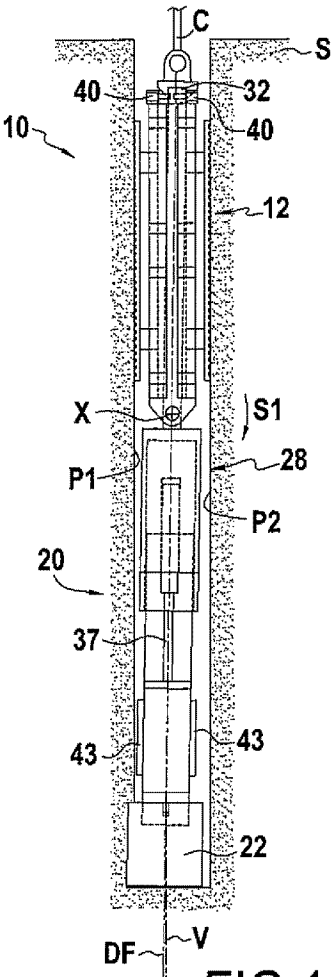
FIG. 11 is a side view of the FIG. 7 machine, with the anchor device activated and with the drilling module pivoted relative to the anchor module in a first direction.
Figure 10:
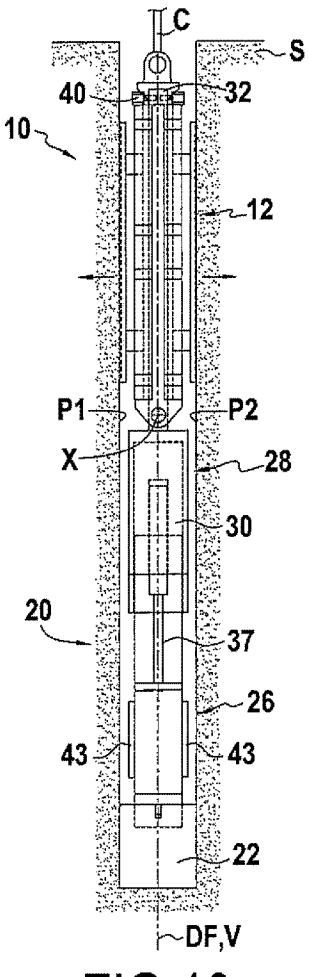
FIG. 10 is a side view of the FIG. 7 machine with the anchor device activated.
Figure 9:
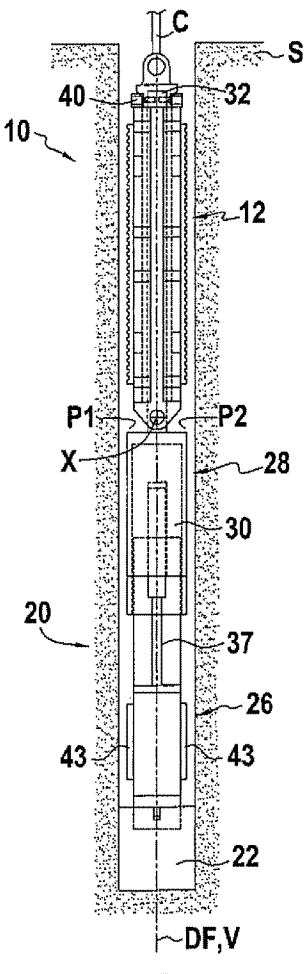
FIG. 9 is a side view of the FIG. 7 machine.

With reference to FIGS. 5 to 7, it can be seen that in this first variant of the first embodiment, the first path correction means 40 are arranged on the anchor module 12 at its top end 12*a*, and they are configured to exert thrust along a first direction T1 or along a second direction T2 opposite to T1, these two directions extending transversely relative to the drilling direction DF, whereby actuating the first path correction means 40 causes the drilling module to pivot relative to the anchor module about the pivot axis X in one direction or the other. It can also be seen that the movement means 35, specifically the thrust actuators 37, are pivotally mounted relative to the anchor module 12 to pivot about the pivot axis X.

More precisely, in this first variant, the first path correction means 40 that are situated at the top end 12*a* of the anchor module 12 are arranged between the top end of the anchor module and the top portion of the top section 28 of the drilling module, such that thrust exerted by the first path correction means 40 has the effect of causing the drilling module to pivot about the pivot axis X. As can be seen in FIG. 7, the first path correction means 40 are arranged on either side of the top portion of the top section 28 of the drilling module.

By way of example, in FIG. 5, the first path correction means 40 exerting transverse thrust T1 directed towards the wall P2 of the excavation E, has the effect of causing the drilling module to pivot about the pivot axis X in a pivot direction S1, thereby causing the cutter members 22 to move closer towards the opposite wall P1, as shown in FIG. 5. Considered in a plane perpendicular to the pivot axis X, the drilling direction DF presents an angle $\alpha$1 relative to the bottom direction. Conversely, as shown in FIG. 6, thrust exerted by the first path correction means 40 in a direction T2, opposite to the direction T1, has the effect of causing the drilling module to pivot relative to the anchor module through an angle $\alpha$2 about the pivot axis X in a pivot direction S2 opposite to the pivot direction S1, thereby causing the cutter members to tend to move towards the wall P2 of the excavation E.

The first path correction means 40 comprise thrust pads 42 that are actuated by the actuators 44 mounted at the top end 12*a* of the drilling module 12.

With reference once more to FIG. 2, it can be seen that the lift cable C is fastened at its bottom end C1 to a fastener member 41 that is secured to the top end of the top portion 32 of the top section 28 of the drilling module 20. As mentioned above, the top end of the top portion of the top section of the drilling module projects above the top end 12*a* of the anchor module 12.

Figure 1:
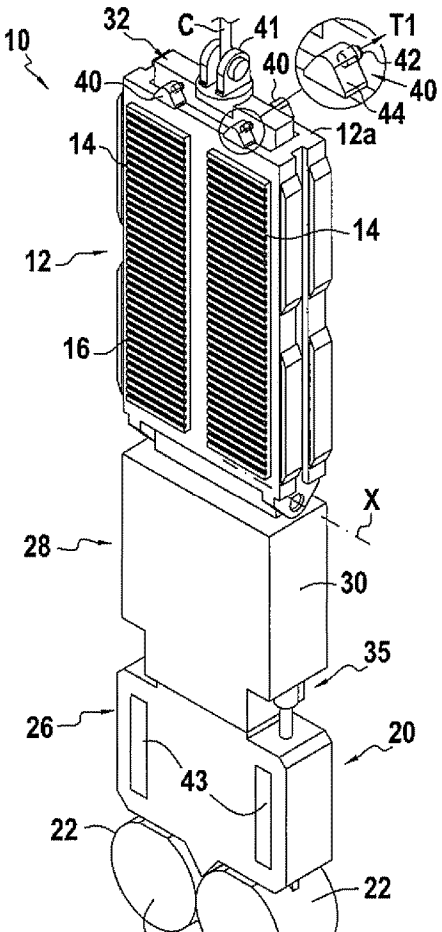
FIG. 1 is a perspective view of a first variant of a first embodiment of the drilling machine in accordance with the invention, the drilling module being in its retracted position, the anchor device being deactivated.

With reference to FIG. 1, it can be seen that the drilling machine also has second path correction means 43 that are situated on the bottom section 26 of the drilling module 20 and that are configured to exert thrust against the excavation walls P1, P2 transversely relative to the drilling direction DF. Thus, combined actuation of the first and second path correction means 40 and 43 serves to facilitate pivoting the drilling module 20 relative to the anchor module 12 above the pivot axis X.

In this example, the second path correction means 43 are pads arranged on the front and rear faces of the bottom section of the drilling module 20.

In this example, the drilling machine 10 has damper means 45 for damping the vibration generated by the cutter members 22 while drilling. In this variant, the damper means 45 comprise a hydraulic damper device that is connected to the hydraulic circuits powering the thrust actuators 37.

There follows a description of an example of the use of the drilling machine 10. While drilling ground, after the drilling machine 10 has been inserted into the ground, the anchor devices are actuated in order to hold the anchor module 12 stationary, as shown in FIG. 4. Thereafter, with the cutter members activated, the thrust actuators 37 are actuated in order to push against on the cutter members. Finally, the drilling module is caused to pivot in order to correct the drilling direction DF, should that be necessary. In another use, the drilling direction is corrected and then the anchor devices are actuated prior to activating the cutter members and actuating the thrust actuators.

With reference to FIGS. 13 to 20, there follows a description of a second variant of the first embodiment of the drilling machine 110 of the invention. The drilling machine 110 has an anchor module 112 that is provided with four anchor devices 114 to prevent the anchor module 112 from moving relative to the ground S in the drilling direction, in particular during a drilling operation, by bearing against the walls P1 and P2 of the excavation E.

The anchor devices 114 comprise a plurality of deployable anchor pads 116 that are suitable for bearing against the walls P1, P2 of the excavation E in order to prevent the anchor module from moving vertically relative to the ground S. In this second embodiment, the anchor devices 114 extend over the full height of the anchor module, the anchor pads forming four rows that extend along lateral ends of the front and rear faces of the drilling module.

The drilling machine 110 also has a drilling module 120 that is provided with a cutter member 112 similar to the cutter members of the first embodiment. These cutter members are connected to the anchor module 112 while being movable in translation relative to said anchor module.

The drilling machine 110 has movement means 135 for moving the cutter members 122 relative to the anchor module 112, these movement means including a thrust device 136 comprising thrust actuators 137 arranged between the anchor module and the drilling module. The thrust device 136 is configured to exert thrust on the cutter members 122 downwardly along the drilling direction DF. The drilling module has a bottom section 126 carrying the cutter members 122, and a top section 128 that extends inside the anchor module 112.

Figure 20:
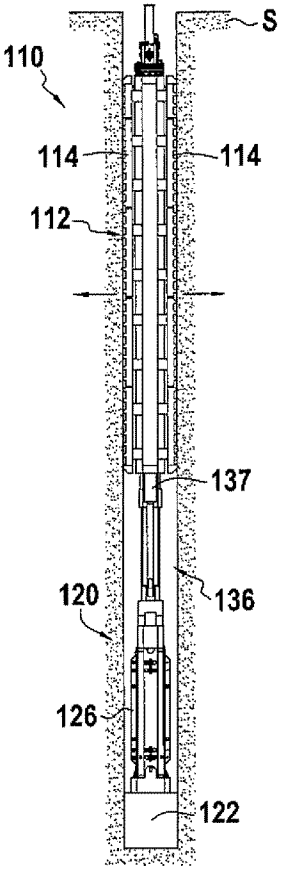
FIG. 20 is a side of the FIG. 18 machine, with the anchor module activated.
Figure 19:
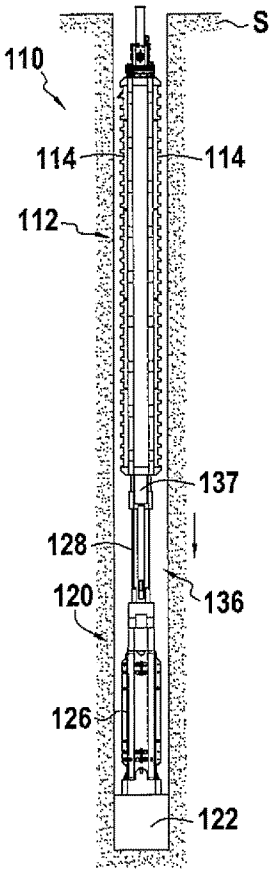
FIG. 19 is a side view of the FIG. 18 machine.

More precisely, the top section 128 of the drilling module is mounted to slide inside the anchor module 112 along the longitudinal direction of the anchor module. Actuating the thrust actuators 137 has the effect of moving the assembly constituted by the bottom section 126 and the top section 128 of the drilling module relative to the anchor module, as shown in FIGS. 19 and 20.

Figure 16:
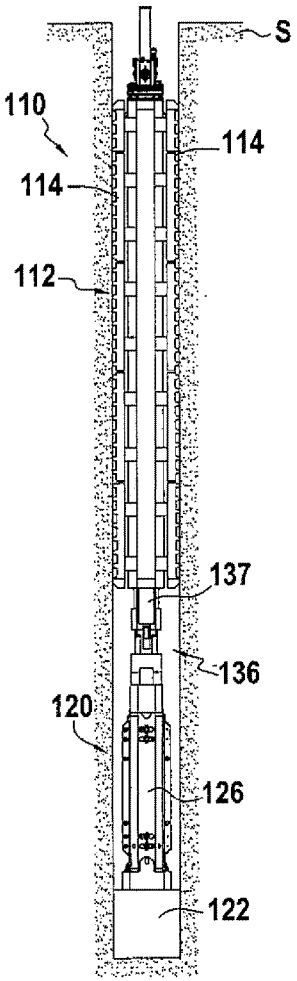
FIG. 16 is a side view of the FIG. 13 machine, with the anchor device activated.
Figure 15:
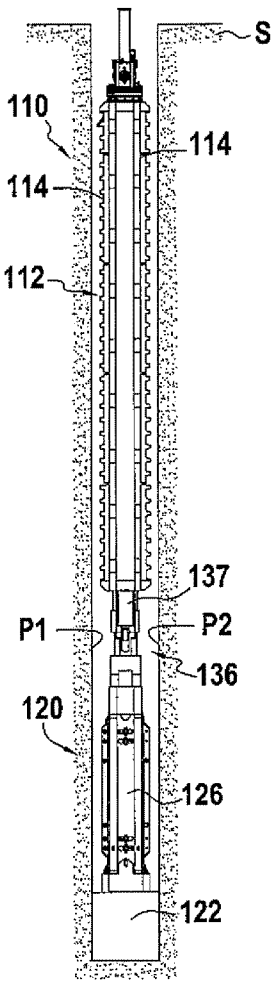
FIG. 15 is a side view of the FIG. 13 machine.
Figure 14:
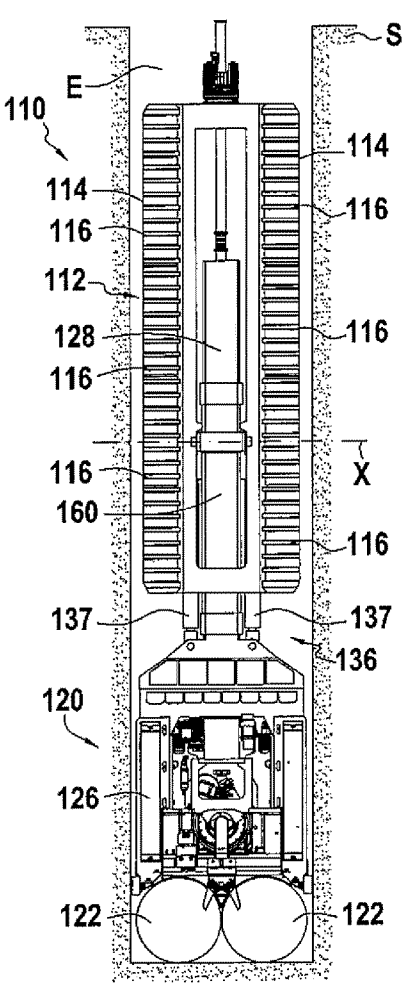
FIG. 14 is a face view of the FIG. 13 machine.

Like the first variant, the thrust actuators 137 are preferably actuated only after the anchor module 112 has been held stationary in the ground. In FIGS. 16 and 20, it can be seen that the drilling machine 110 is stationary in the ground S as a result of actuating the anchor devices 114. FIG. 20 shows the module of FIG. 16 after the thrust actuators 137 have been actuated so as to exert downward thrust on the cutter members 122.

In accordance with the invention, the drilling module 120 is also hinged relative to the anchor module 112. Like the first embodiment, this hinge consists in a pivot connection about a pivot axis X enabling the drilling module 120 to pivot relative to the anchor module 112 as in the first variant, the pivot axis X being substantially horizontal.

Figure 13:
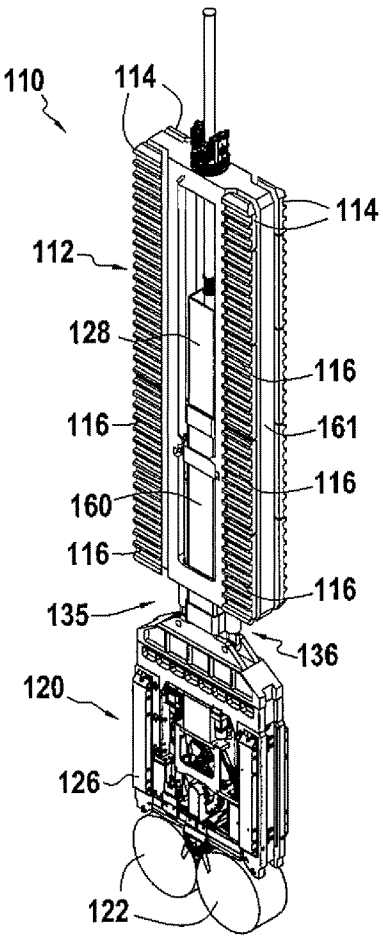
FIG. 13 is a perspective view of a second variant of the first embodiment of the drilling machine, the drilling module being in its retracted position.

With reference to FIG. 13, it can be seen that the top section 128 of the drilling module 120 is in the form of a longitudinal bar that is engaged in a sleeve 160 that is hinged relative to the body 161 of the drilling module 112. It can be understood that the sleeve 160 forms part of the anchor module 112 and forms a tube in which the top section 128 of the drilling module 120 can slide. The sleeve 160 is mounted to pivot relative to the body 161 of the anchor module about the pivot axis X.

The drilling module 120 is pivoted relative to the anchor module 112 by causing the sleeve 160 to pivot relative to the body 161 of the anchor module 112 about the pivot axis X, the pivoting of the sleeve 160 causing the top section 128 of the drilling module to pivot and thus causing the drilling module 120 to pivot in pivot direction S1 or in pivot direction S2.

It is specified that the thrust actuators 137 are arranged between the sleeve 161 and the bottom section of the drilling module, such that the thrust device 136 pivots together with the drilling module 120.

Figure 17:
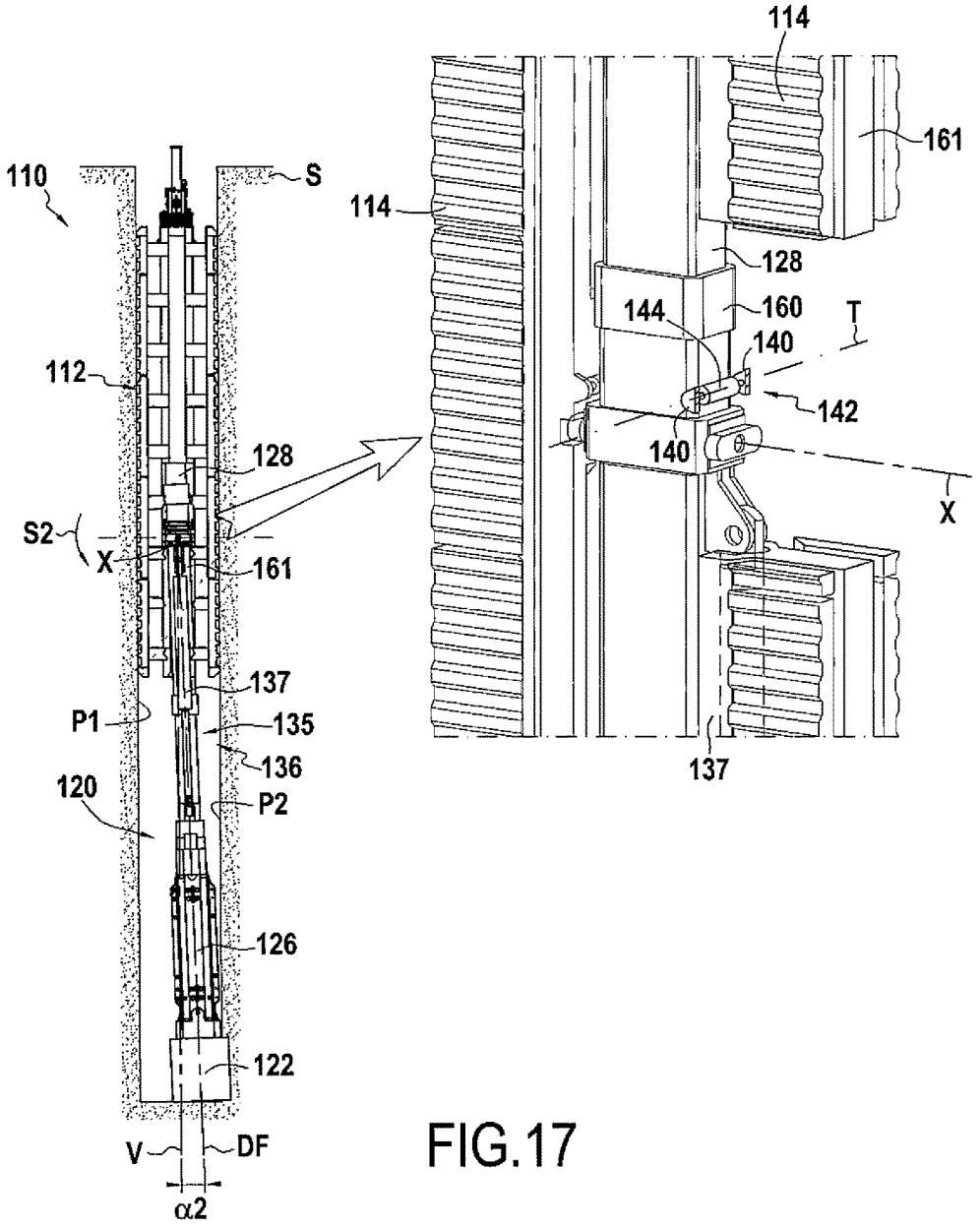
FIG. 17 is a side view of the FIG. 13 machine with the anchor device activated and with the drilling module pivoted relative to the anchor module in a first direction.

In order to perform this pivoting, the drilling machine has first path correction means 140 that can be seen more clearly in the detail view of FIG. 17, and that can be actuated and configured so as to cause the sleeve 160 to pivot relative to the body 161 of the anchor module about the pivot axis X. In the example of FIG. 17, the drilling direction DF corresponds to the longitudinal axis of the top section 128 of the drilling module, and thus also corresponds to the longitudinal direction of the sleeve 160. It can be understood that the pivot axis X is perpendicular to the drilling direction DF. It can also be seen in FIG. 17 that the movement means 135, specifically thrust actuators 137, are mounted to pivot relative to the anchor module 112 about the pivot axis X.

The anchor module 112 has the first path correction means 140, which are configured to exert thrust on the drilling module 120 along a direction T that extends transversely relative to the drilling direction DF, such that actuating the first path correction means causes the drilling module to pivot relative to the anchor module. For this purpose, the first path correction means 140 are arranged between the sleeve 160 and the body 161 of the anchor module so that actuating the first path correction means 140 in the direction T has the effect of causing the sleeve 160 to pivot relative to the body 161 of the anchor module about the pivot axis X.

In this example, the first path correction means 140 comprise thrust pads 142 that are actuated by actuators 144 mounted on the sleeve 160 of the anchor module.

Figure 21:
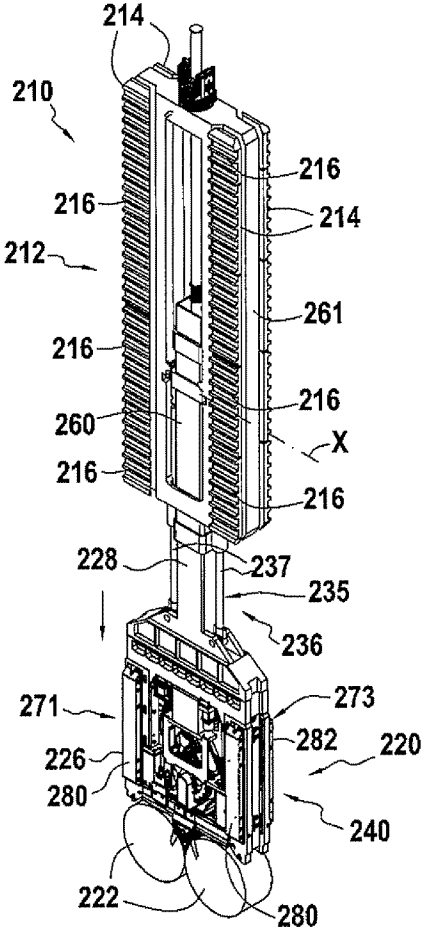
FIG. 21 is a perspective view of a second embodiment of the drilling machine of the invention.

FIG. 21 shows a second embodiment of the drilling machine 210 of the invention. The drilling machine 210 is similar to the second variant of the first embodiment.

Figure 18:
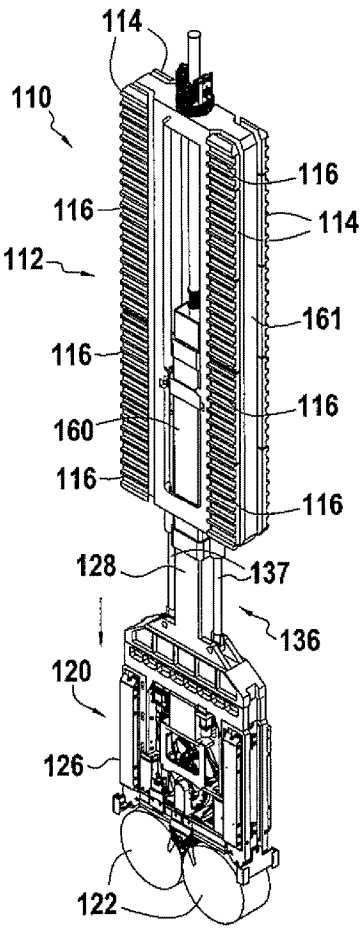
FIG. 18 is a perspective view of the second variant of the first embodiment of the drilling machine, the drilling module being in its deployed position.

Elements of the machine 210 shown in FIG. 21 that correspond to elements of the drilling machine 110 shown in FIGS. 17 and 18 are given the same references, plus a value of one hundred.

The drilling machine 210 differs from the machine of FIG. 18 essentially by the fact that, in this second embodiment, the first path correction means 280, 282 are arranged on the drilling module 220, and more particularly on the front face 271 and on the rear face 273 of its bottom section 226.

The first path correction means 240 are configured to exert thrust against one or the other of the walls P1 and P2 of the excavation in a direction that extends transversely to the drilling direction.

In the example of FIG. 21, the first path correction means comprise thrust pads that extend along the height to the bottom section 226 of the drilling module 220 and that are configured to be deployed transversely so as to push against one or the other of the walls P1 and P2 in the desired pivoting direction. In this example, each of the front and rear faces has a pair of thrust pads.

Actuating the first path correction means has the effect of causing the drilling module to pivot relative to the anchor module about the pivot axis X.

The invention claimed is:

1. A drilling machine for making an excavation in ground in a drilling direction, said excavation having walls and said drilling machine comprising:

an anchor module having at least one anchor device for preventing the anchor module from moving in the drilling direction relative to the ground by bearing against one of the walls of the excavation;

a drilling module provided with cutter members, the cutter members being connected to the anchor module while being movable in translation relative to the anchor module; and a movement device for moving the cutter members in translation relative to the anchor module;

wherein the drilling module is hinged relative to the anchor module, and wherein the drilling module further comprises at least a first path correction device configured to cause the drilling module to pivot relative to the anchor module about a pivot axis perpendicular to the drilling direction.

2. The drilling machine according to claim 1, wherein the anchor module includes the first path correction device that is configured to exert thrust on the drilling module in a direction extending transversely relative to the drilling direction, whereby actuating the first path correction device causes the drilling module to pivot relative to the anchor module.

3. The drilling machine according to claim 2, wherein the drilling machine has a bottom section carrying the cutter members, and a top section extending at least in part inside the anchor module, and wherein the first path correction device is arranged between the anchor module and the top section of the drilling module.

4. The drilling machine according to claim 3, wherein the drilling machine further comprises a second path correction device that is situated on the bottom section of the drilling module and that are configured to exert thrust on one of the walls of the excavation transversely relative to the drilling direction.

5. The drilling machine according to claim 1, wherein the first path correction device comprises at least one thrust pad.

6. The drilling machine according to claim 5, wherein the thrust pad is actuated by an actuator mounted on the anchor module.

7. The drilling machine according to claim 1, wherein the first path correction device is arranged on the drilling module and is configured to exert thrust on one of the walls of the excavation in a direction that extends transversely relative to the drilling direction, whereby actuating the first path correction device causes the drilling module to pivot relative to the anchor module.

8. The drilling machine according to claim 1, wherein the movement device is mounted to pivot relative to the anchor module.

9. The drilling machine according to claim 1, wherein the movement device comprises a thrust device for exerting downwardly directed thrust on the cutter members along the drilling direction.

10. The drilling machine according to claim 9, wherein the thrust device includes at least one thrust actuator arranged between the anchor module and the drilling module.

11. The drilling machine according to claim 1, wherein the anchor device has at least one anchor pad suitable for bearing against one of the walls of the excavation to prevent the anchor module from moving along the drilling direction relative to the ground.

12. The drilling machine according to claim 1, wherein the drilling machine also has a damper device for damping the vibration generated by the cutter members while drilling.

13. The drilling machine according to claim 1, including a lift cable, with the drilling module being suspended from the bottom end thereof.

14. The drilling machine to claim 13, wherein the top section of the drilling module passes through the anchor module and the lift cable is fastened to the top end of the top section of the drilling module.

15. The drilling machine according to claim 1, wherein the drilling machine is a milling machine in which the cutter members comprise two pairs of drums that are rotatable about axes of rotation that are parallel, distinct, and perpendicular to the drilling direction.

16. The drilling machine according to claim 15, wherein the first path correction device is configured to cause the drilling module to pivot relative to the anchor module about a pivot axis that is perpendicular to the drilling direction and to the axes of rotation of the drums.

* * * * *